US009603196B2

(12) United States Patent
Irgens et al.

(10) Patent No.: US 9,603,196 B2
(45) Date of Patent: Mar. 21, 2017

(54) SELF-REGULATING SEMI-CONDUCTIVE FLEXIBLE HEATING ELEMENT

(71) Applicant: TECH DESIGN LLC, Maryland Heights, MO (US)

(72) Inventors: O. Stephan Irgens, St. Charles, MO (US); Monica Irgens, St. Charles, MO (US)

(73) Assignee: Tech Design LLC, Maryland Heights, MO (US)

( * ) Notice: Subject to any disclaimer, the term of this patent is extended or adjusted under 35 U.S.C. 154(b) by 418 days.

(21) Appl. No.: 14/104,727

(22) Filed: Dec. 12, 2013

(65) Prior Publication Data

US 2014/0166638 A1 Jun. 19, 2014

Related U.S. Application Data

(60) Provisional application No. 61/737,212, filed on Dec. 14, 2012.

(51) Int. Cl.

| | |
|---|---|
| ***H05B 3/14*** | (2006.01) |
| ***H05B 3/34*** | (2006.01) |
| ***H01B 1/04*** | (2006.01) |
| ***H05B 3/36*** | (2006.01) |

(52) U.S. Cl.

CPC ..... *H05B 3/34* (2013.01); *H01B 1/04* (2013.01); *H05B 3/14* (2013.01); *H05B 3/146* (2013.01); *H05B 3/36* (2013.01); *H05B 2203/011* (2013.01); *H05B 2203/016* (2013.01); *H05B 2203/017* (2013.01); *H05B 2203/02* (2013.01); *H05B 2203/026* (2013.01); *H05B 2214/02* (2013.01)

(58) Field of Classification Search

None

See application file for complete search history.

(56) References Cited

U.S. PATENT DOCUMENTS

| | | | |
|---|---|---|---|
| 2,241,312 | A | 5/1941 | Luty |
| 3,157,097 | A | 11/1964 | Stinnett, Jr. et al. |
| 3,239,403 | A | 3/1966 | Williams et al. |
| 3,757,087 | A | 9/1973 | Bernard |

(Continued)

FOREIGN PATENT DOCUMENTS

| | | | |
|---|---|---|---|
| CA | 2070456 | A1 | 9/1992 |
| DE | 10003802 | A1 | 2/2000 |

(Continued)

OTHER PUBLICATIONS

International Search Report and Written Opinion, TECH DESIGN, LLC, Application No. PCT/US 13/74944, Apr. 8, 2014, 14 pages.

(Continued)

*Primary Examiner* — Joseph M Pelham

(74) *Attorney, Agent, or Firm* — Armstrong Teasdale LLP

(57) ABSTRACT

A flexible homogeneous carbon polymeric heating element is provided. The flexible homogeneous carbon polymeric heating element includes a pair of layers of a first insulating material, a pair of layers of a second insulating material positioned between the pair of first insulating material layers, and an elongate web positioned between the pair of second insulating material layers, wherein one of the insulating materials is a chemical-resistant material, and the other of the insulating materials is a water-resistant material.

9 Claims, 7 Drawing Sheets

(56) References Cited

U.S. PATENT DOCUMENTS 3,774,299 A 11/1973 Sato et al.
3,858,144 A * 12/1974 Bedard ..... H01B 3/44 219/505
3,861,029 A * 1/1975 Smith-Johannsen .. H01C 7/027 219/528
3,900,654 A 8/1975 Stinger
3,914,363 A * 10/1975 Bedard ..... B29C 47/02 174/120 SC
4,250,397 A 2/1981 Gray et al.
4,251,712 A 2/1981 Parr
4,286,376 A * 9/1981 Smith-Johannsen .... H05B 3/56 264/105
4,327,480 A * 5/1982 Kelly ..... H01B 1/24 219/528
4,444,708 A * 4/1984 Gale ..... B29C 47/027 264/105
4,471,215 A * 9/1984 Blumer ..... H05B 3/56 219/528
4,488,033 A 12/1984 Trachtenberg
4,645,146 A 2/1987 Hall
4,656,339 A 4/1987 Grise
4,661,689 A 4/1987 Harrison
4,677,801 A 7/1987 Bard
4,725,717 A 2/1988 Harrison
4,818,312 A 4/1989 Benge
4,910,388 A 3/1990 Lorenz et al.
4,983,814 A 1/1991 Ohgushi et al.
5,015,824 A 5/1991 Monter et al.
5,057,673 A * 10/1991 Farkas ..... H01C 7/027 219/549
5,100,494 A 3/1992 Schmidt
5,286,952 A * 2/1994 McMills ..... B29C 61/006 156/105
5,313,034 A 5/1994 Grimm et al.
5,422,462 A 6/1995 Kishimoto
5,444,228 A 8/1995 Gelus
5,624,750 A 4/1997 Martinez et al.
5,961,869 A * 10/1999 Irgens ..... H05B 3/36 219/213
6,172,344 B1 * 1/2001 Gordon ..... H05B 3/34 219/497
2007/0210073 A1 9/2007 Hubert et al.
2008/0230530 A1 * 9/2008 Augustine ..... H05B 3/342 219/212
2010/0193367 A1 8/2010 Luch
2012/0142832 A1 6/2012 Varma et al.
2012/0168430 A1 7/2012 Seo
2012/0247641 A1 10/2012 Ruggiero et al.
2013/0186884 A1 * 7/2013 Barfuss ..... B23P 11/00 219/529
2014/0187140 A1 * 7/2014 Lazanja ..... B60N 2/5685 454/236

FOREIGN PATENT DOCUMENTS

EP 0175550 A1 3/1986
EP 0242787 A1 10/1987
EP 0486891 A1 5/1992
EP 0486892 A1 5/1992
EP 0536165 B1 * 7/1995 ..... H05B 3/146
GB 2052224 A 1/1981
GB 2228165 A 8/1990
GB 2304510 A 3/1997
KR 20100034514 A 1/2010
WO 9809478 A1 3/1998

OTHER PUBLICATIONS

Extended European Search Report for PCT/US2013074944, dated Apr. 16, 1929.

* cited by examiner

SELF-REGULATING SEMI-CONDUCTIVE FLEXIBLE HEATING ELEMENT

CROSS REFERENCE TO RELATED APPLICATIONS

This application claims the benefit of U.S. Provisional Patent Application No. 61/737,212 filed Dec. 14, 2012, which is hereby incorporated by reference in its entirety.

BACKGROUND OF THE DISCLOSURE

This invention relates to self-regulating semi-conductive flexible heating elements, and in particular to flexible, homogeneous carbon polymeric heating elements configured to resist water and chemical damage.

Flexible homogeneous carbon polymeric heating elements have been employed in a number of applications, particularly in heating floors, melting snow, and deicing. These elements typically include an elongate web of an electrically conductive plastic, such as a polyethylene and carbon black mixture. There are bus conductors embedded in the web, extending longitudinally adjacent each edge of the web. These bus conductors may be, for example, a braided wire. The bus conductors allow a potential to be applied transversely across the web, thereby generating heat. The elongate web is extruded as a flat heating element. To increase the flexibility of the web and decrease the cross sectional area of the web, a plurality of slots can be cut transversely across the web.

At least some known heating elements are made from an electrically conductive homogeneous low density polyethylene. These heating elements are capable of operating at low voltages (e.g., 30 volts or less), and are self-regulating because as the temperature of the element increases, the resistance increases, decreasing the current and thus the heat being generated. Moreover, as compared to alternative heating systems, the use of these heating elements in floors may provide a more even heat distribution, greater comfort, less temperature stratification, better control, increased ability to provide zoning, and/or the elimination of forced air which can circulate dust and germs. These heating elements are also capable of operating at line voltage (e.g., up to 277 volts) for concrete applications.

However, exposure to water, chemicals, and other environmental conditions may damage at least some known heating elements, reducing the durability, conductivity, and/or efficiency of the damaged heating elements. Further, at least some known protective liners may delaminate over time, allowing water and/or chemicals to reach and damage the heating element. Specifically, the water and/or chemicals may encapsulate the carbon molecules in the heating element, impairing the ability of the carbon to transfer electricity. Moreover, at least some protective liners themselves may interact adversely with the heating element, choking the carbon and inhibiting transfer of electricity.

BRIEF DESCRIPTION OF THE DISCLOSURE

In one aspect, a flexible homogeneous carbon polymeric heating element is provided. The flexible homogeneous carbon polymeric heating element includes a pair of layers of a first insulating material, a pair of layers of a second insulating material positioned between the pair of first insulating material layers, and an elongate web positioned between the pair of second insulating material layers, wherein one of the insulating materials is a chemical-resistant material, and the other of the insulating materials is a water-resistant material.

In another aspect, a method for producing a flexible homogeneous carbon polymeric heating element is provided. The method includes extruding an elongate web and a plurality of bus conductors through a die such that the plurality of bus conductors are embedded within the elongate web, and thermally bonding a first liner and a second liner to the elongate web including the embedded bus conductors, wherein the first liner and the second liner each include a layer of a water-resistant material and a layer of a chemical-resistant material.

BRIEF DESCRIPTION OF THE DRAWINGS

Corresponding reference numerals indicate corresponding parts throughout the several views of the drawings.

DETAILED DESCRIPTION OF THE DISCLOSURE

The embodiments described herein provide a flexible homogeneous carbon polymeric heating element. The flexible element includes an electrically conductive elongate web insulated by a first insulating material and a second insulating material. The first insulating material is water-resistant, and the second insulating material is chemical-resistant. Accordingly, the first and second insulating materials prevent water and chemicals from reaching and damaging the elongate web (e.g., by encapsulating and choking the carbon molecules in the elongate web). Further, the flexible heating element includes features that facilitate protecting a user from electrical discharge.

Figure 1:
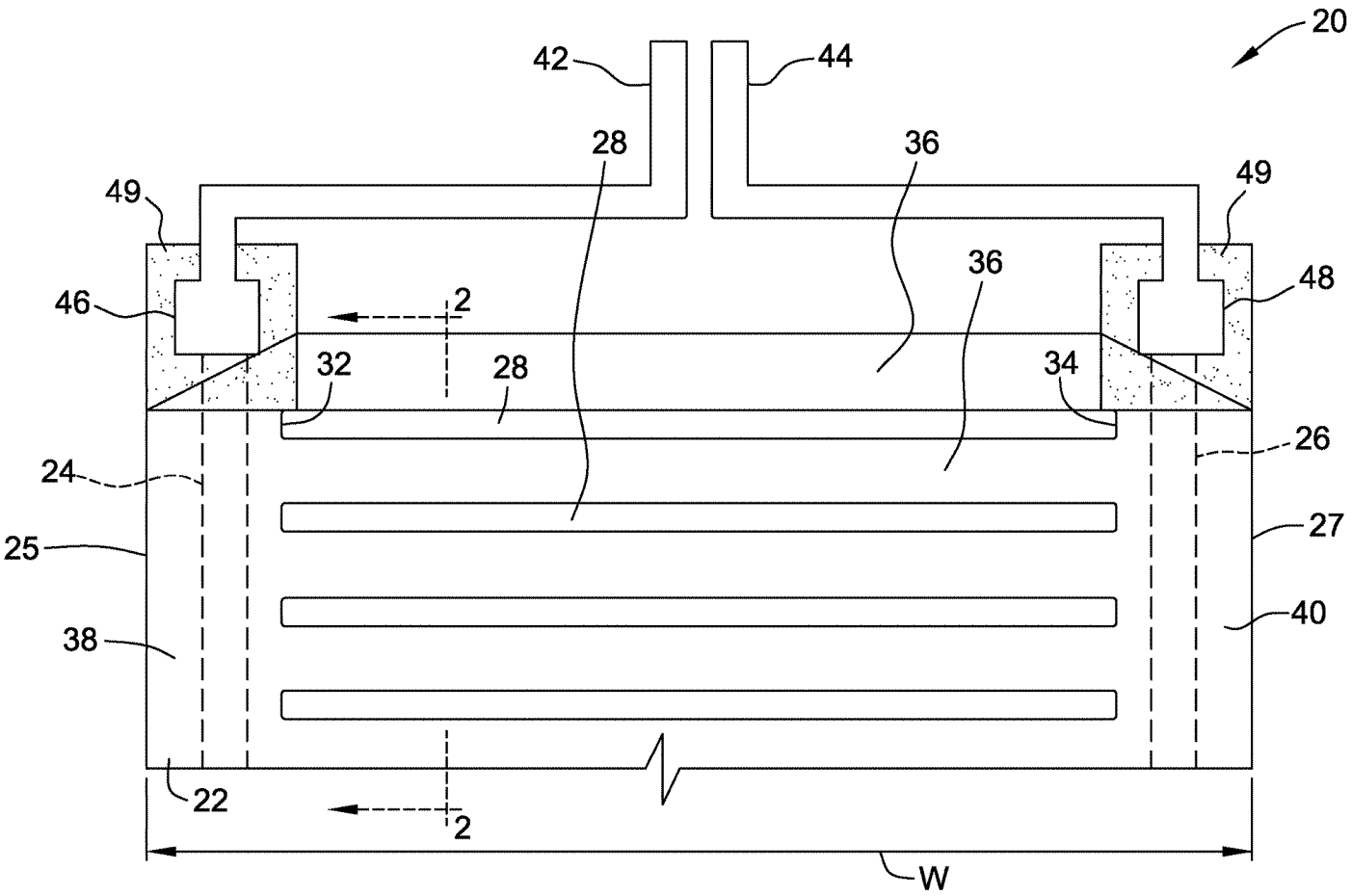
FIG. 1 is a top plan view of an example flexible homogeneous carbon polymeric heating element.
Figure 2A:
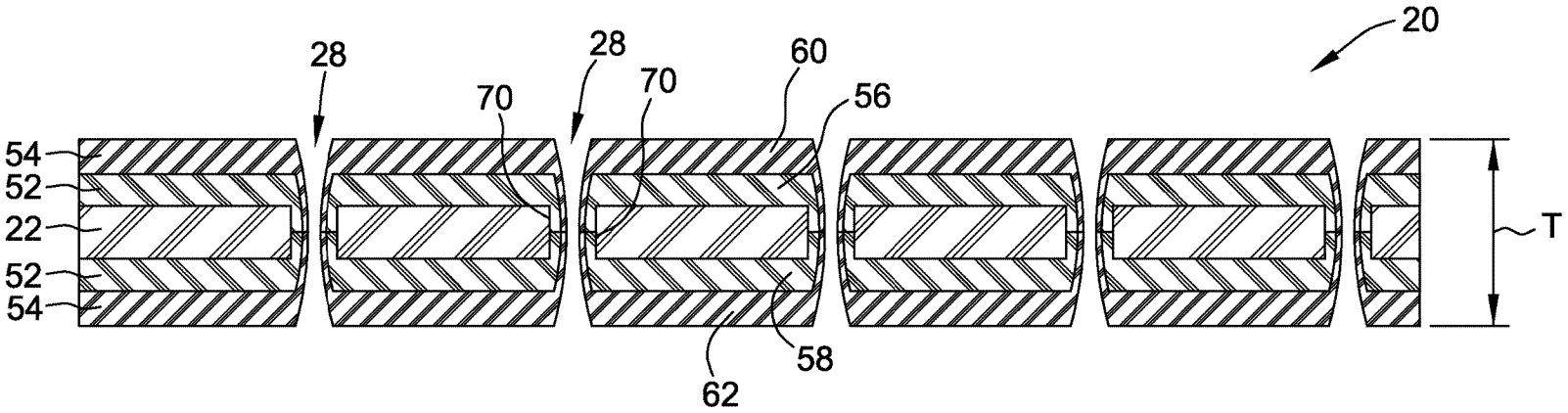
FIG. 2A is a partial longitudinal cross-sectional view of the flexible homogeneous carbon polymeric heating element taken along line 2-2 in FIG. 1.
Figure 2B:
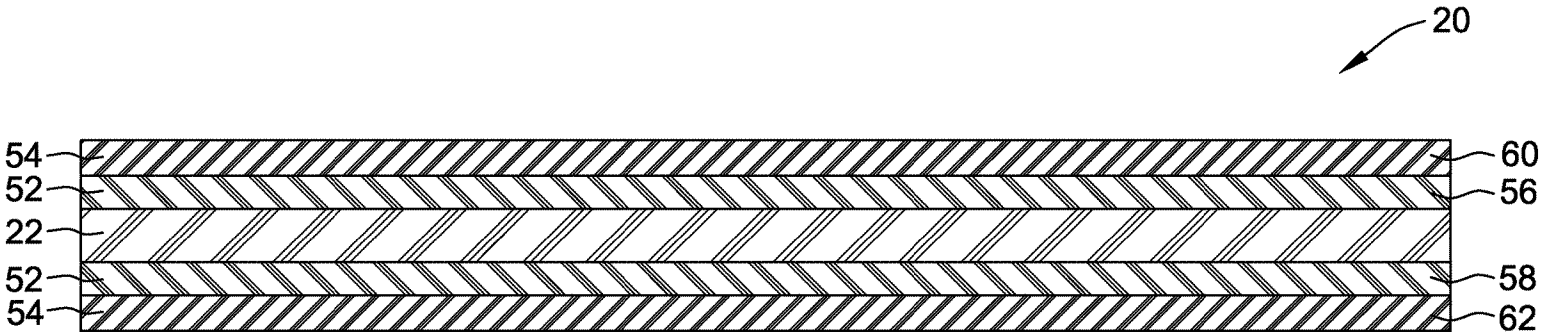
FIG. 2B is a partial longitudinal cross-sectional view of the flexible homogeneous carbon polymeric heating element taken along line 2-2 in FIG. 1 with the slots omitted.

FIG. 1 is a top plan view of an example flexible homogeneous carbon polymeric heating element 20. FIG. 2A is a partial longitudinal cross-sectional view of flexible homogeneous carbon polymeric heating element 20 taken along line 2-2 in FIG. 1. FIG. 2B is a partial longitudinal cross-sectional view of flexible homogeneous carbon polymeric heating element 20 taken along line 2-2 in FIG. 1 with slots omitted.

Heating element 20 includes an elongate web 22 of a flexible, electrically conductive plastic. Elongate web 22 is encased in insulating materials (not shown in FIG. 1), as described in detail herein. In the example embodiment, elongate web 22 is a semi-conductive polymer including polyethylene mixed with carbon black, and has a thickness between 1.0 millimeters (mm) and 1.5 mm, such as approximately 1.10 millimeters (mm). Alternatively, elongate web 22 may be made of any material and have any thickness that enables elongate web 22 to function as described herein. In the example embodiment, heating element 20 has a width, W, between 7 centimeters (cm) and 35 cm, a thickness, T, between 1.0 mm and 1.5 mm, and may be as long as approximately 100 meters (m). Alternatively, heating element 20 may have any dimensions that enable heating element 20 to function as described herein. For example, the length may be calculated and designed for specific applications of heating element 30.

A first bus conductor 24 extends adjacent a first side 25 of elongate web 22, and a second bus conductor 26 extends adjacent a second side 27 of elongate web 22. First and second bus conductors 24 and 26 are embedded in elongate web 22. First and second bus conductors 24 and 26 each may be, for example, a braided wire. In some embodiments, heating element 20 may include additional bus conductors.

In one example embodiment, elongate web 22, and accordingly, heating element 20, has a plurality of transversely extending slots 28 defined therein. Slots 28 extend substantially across a width of heating element 20 and preferably have a constant width, except at their ends 32 and 34. Slots 28 define a plurality of transversely extending "rungs" 36 that extend between longitudinally extending "rails" 38 and 40. First bus conductor 24 is embedded in elongate web 22 at rail 38, and second bus conductor 26 is embedded in elongate web 22 at rail 40. Lead wires 42 and 44 are physically secured to heating element 20 and electrically connected to bus conductors 24 and 26, respectively, using crimp connectors 46 and 48. As shown in FIG. 1, to connect lead wire 42 and 44 to bus conductors 24 and 26, portions of heating element 20 may be removed (e.g., cut using scissors) at corner regions 49 to expose a portion of bus conductors 24 and 26.

Elongate web 22 is encased in a first insulating material 52 and a second insulating material 54. More specifically, as shown in FIG. 2, elongate web 22 is positioned between a first layer 56 of first insulating material 52 and a second layer 58 of first insulating material 52. Further, the combination of elongate web 22, first layer 56, and second layer 58 is positioned between a first layer 60 of second insulating material 54 and a second layer 62 of second insulating material 54. In one embodiment, first insulating material first layer 56 and second insulating material first layer 60 are fused together as a first liner, and first insulating material second layer 58 and second insulating material second layer 62 are fused together as a second liner. In embodiments including slots 28, as shown in FIG. 2A, layers 56, 58, 60, and 62 are compressed together to insulate exposed edges 70 of elongate web 22.

First and second insulating materials 52 and 54 facilitate protecting elongate web 22 from environmental conditions, such as water and/or chemicals. In the example embodiment, first insulating material 52 is a water-resistant material, such as polyethylene, and second insulating material 54 is a chemical-resistant material, such as polypropylene. As used herein, chemical-resistant means substantially impermeable to at least one chemical, including, but not limited to, alkaline, butyl, plasticizers, and/or aggressive adhesives. Alternatively, first insulating material 52 may be a chemical-resistant material, and second insulating material 54 may be a water-resistant material. The combination of the water-resistant first insulating material 52 and the chemical-resistant second insulating material 54 prevents water and chemicals from reaching and damaging elongate web 22. Further, the choice of relatively similar materials for the first insulating material 54 and the second insulating material 54 facilitates bonding the insulating layers 56, 58, 60, and 62 to elongate web 22 and one another, and also enables recycling elongate web 22.

For example, in one embodiment, first and second layers 56 and 58 are each a layer of low density polyethylene having a thickness between 0.01 mm and 0.03 mm, such as approximately 0.021 mm, and first and second layers 60 and 62 are each a layer of bi-directional oriented polypropylene having a thickness between 0.02 mm and 0.04 mm, such as approximately 0.029 mm. Alternatively, layers 56, 58, 60, and/or 62 may have any composition and/or dimensions that enable elongate web 22 to function as described herein.

Heating element 20 may be mounted on a floor, a ceiling, a wall, a roof, and/or other surfaces to be heated. Heating element 20 may be mounted by driving suitable fasteners (e.g., nails, staples, etc.) through heating element 20. Notably, driving fasteners through heating element 20 does not substantially impair the ability of heating element 20 to generate heat.

Figure 3A:
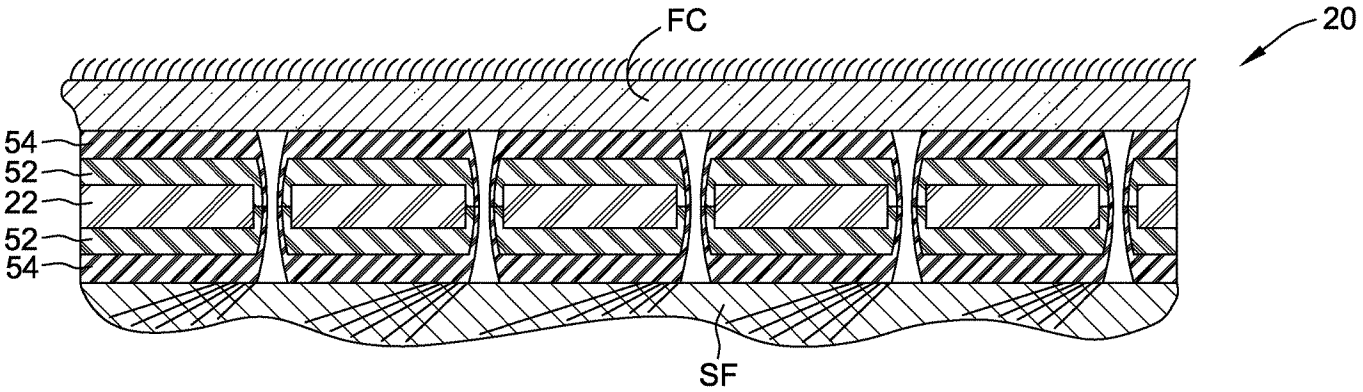
FIG. 3A is a partial longitudinal cross-sectional view of the flexible homogeneous carbon polymeric heating element shown in FIG. 2A positioned between a subfloor and a floor covering.
Figure 3B:
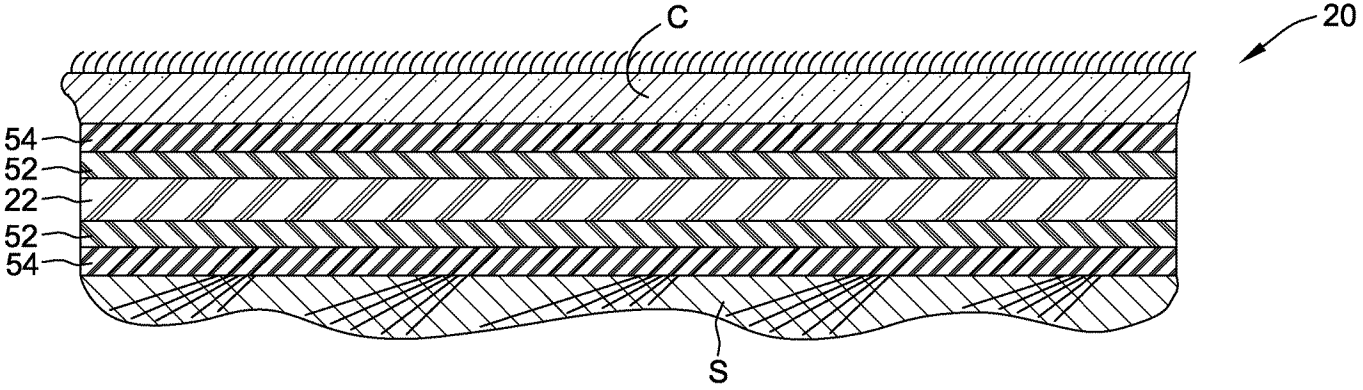
FIG. 3B is a partial longitudinal cross-sectional view of the flexible homogeneous carbon polymeric heating element shown in FIG. 2B positioned between a slab and concrete.

FIG. 3A is a partial longitudinal cross-sectional view of the flexible homogeneous carbon polymeric heating element shown in FIG. 2A positioned between a subfloor SF and a floor covering FC (e.g., carpeting). FIG. 3B is a partial longitudinal cross-sectional view of the flexible homogeneous carbon polymeric heating element shown in FIG. 2B positioned between a slab S and concrete C. The heating elements 20 shown in FIGS. 3A and 3B may include slots 28, or alternatively, may not include slots 28. The subfloor SF or slab S may be cleaned and prepared before positioning and/or mounting heating element 20. In the example embodiment, bus conductors 24 and 26 are connected with crimp connectors 46 and 48 to lead wires 42 and 44 (all shown in FIG. 1), which are in turn connected to an AC and/or DC power source (not shown) to create a potential across elongate web 22, thereby generating heat. For low voltage (e.g., about 30 volts or less) heating elements 20 may be connected to a power supply, isolated or electronic, to solar or wind power, or to a battery. For line voltage applications (e.g., up to 277 volts), heating elements 20 may be connected to a service panel. If a temperature of heating element 20 increases, a resistance of elongate web 22 increases, decreasing a current and thus an amount of heat being generated. If the temperature of heating element 20 decreases, the resistance of elongate web 22 decreases, increasing a current and thus an amount of heat being generated. Accordingly, heating element 20 is substantially self-regulating.

Figure 4:
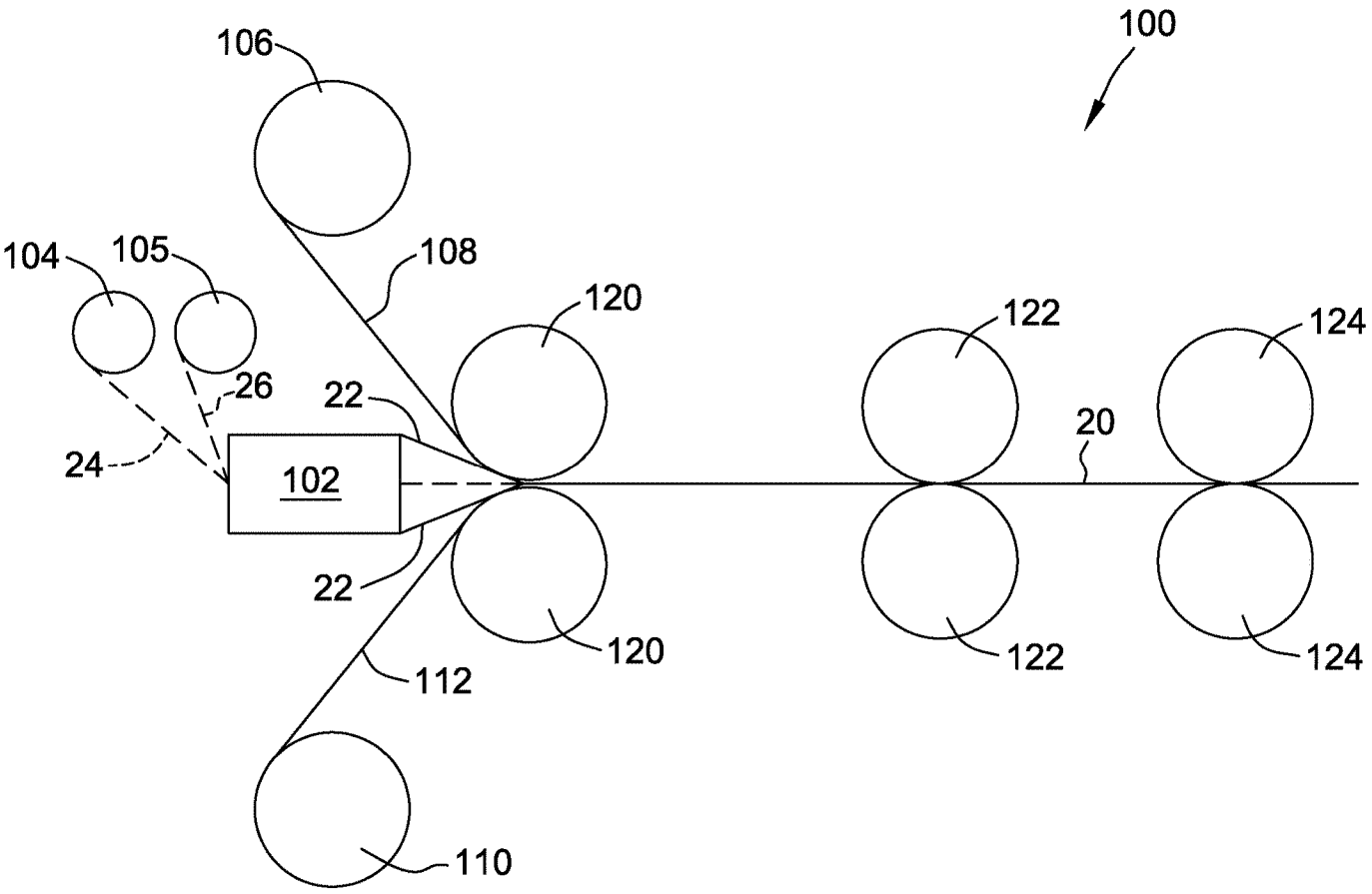
FIG. 4 is a schematic diagram of an example system for producing the flexible homogeneous carbon polymeric heating element shown in FIG. 1.

FIG. 4 is a schematic diagram of an example system 100 for producing the flexible homogeneous carbon polymeric heating element 20 shown in FIG. 1. System 100 includes a die 102 that extrudes elongate web 22 and first and second bus conductors 24 and 26 to embed first and second bus conductors 24 and 26 in elongate web 22. A first reel 104 supplies first bus conductor 24 to die 102, and a second reel 105 supplies second bus conductor 26 to die 102. First and second reels 104 and 105 are each located on a respective side of die 102 in the example embodiment. Alternatively, heating element 20 may include additional reels configured to supply additional bus conductors.

In the example embodiment, system 100 includes a first reel 106 including a first liner 108, and a second reel 110 including a second liner 112. Each liner 108 includes a layer of first insulating material 52 and a layer of second insulating material 54. That is, first liner 108 includes first insulating material first layer 56 and second insulating material first layer 60, and second liner 112 includes first insulating material second layer 58 and second insulating material second layer 62. Accordingly, first and second liners 108 and 112 each include a layer of a water-resistant material and a layer of a chemical-resistant material. Alternatively, separate respective reels may be included for each of first insulating material first layer 56, first insulating material second layer 56, second insulating material first layer 60, and second insulating material second layer 62. First and second liners 108 and 112 may also include indicia (e.g., letters, numbers, and/or other symbols) printed thereon.

To form heating element 20, elongate web 22 with first and second bus conductors 24 and 26 embedded therein, first liner 108 from first reel 106, and second liner 112 from second reel 110 are all passed through and compressed by a pair of temperature controlled rollers 120. In the example embodiment, die 102 is located sufficiently close to temperature controlled rollers 120 such that elongate web 22 enters temperature controlled rollers 120 almost immediately upon exiting die 102.

Temperature controlled rollers 120 melt and compress elongate web 22, first liner 108, and second liner 112 simultaneously to thermally bond elongate web 22, first liner 108, and second liner 112 with one another. Thermally bonding elongate web 22, first liner 108, and second liner 112 with one another simultaneously creates a strong bond and facilitates preventing later delamination of first and second liners 108 and 112 from elongate web 22.

After exiting temperature controlled rollers 120, for embodiments of heating element 20 that are to include slots 28, the thermally bonded combination of elongate web 22, first liner 108, and second liner 112 passes through a pair of cutting rollers 122. At least one cutting roller 122 includes protrusions (not shown) that cut through the combination of elongate web 22, first liner 108, and second liner 112 to produce slots 28 in heating element 20. During the cutting, cutting rollers apply heat and pressure to stretch first and second liners 108 and 112 to cover exposed edges 70 of elongate web 22, as shown in FIG. 2. In the example embodiment, a pair of pulling rollers 124 pull heating element 20 through system 100.

Figure 5:
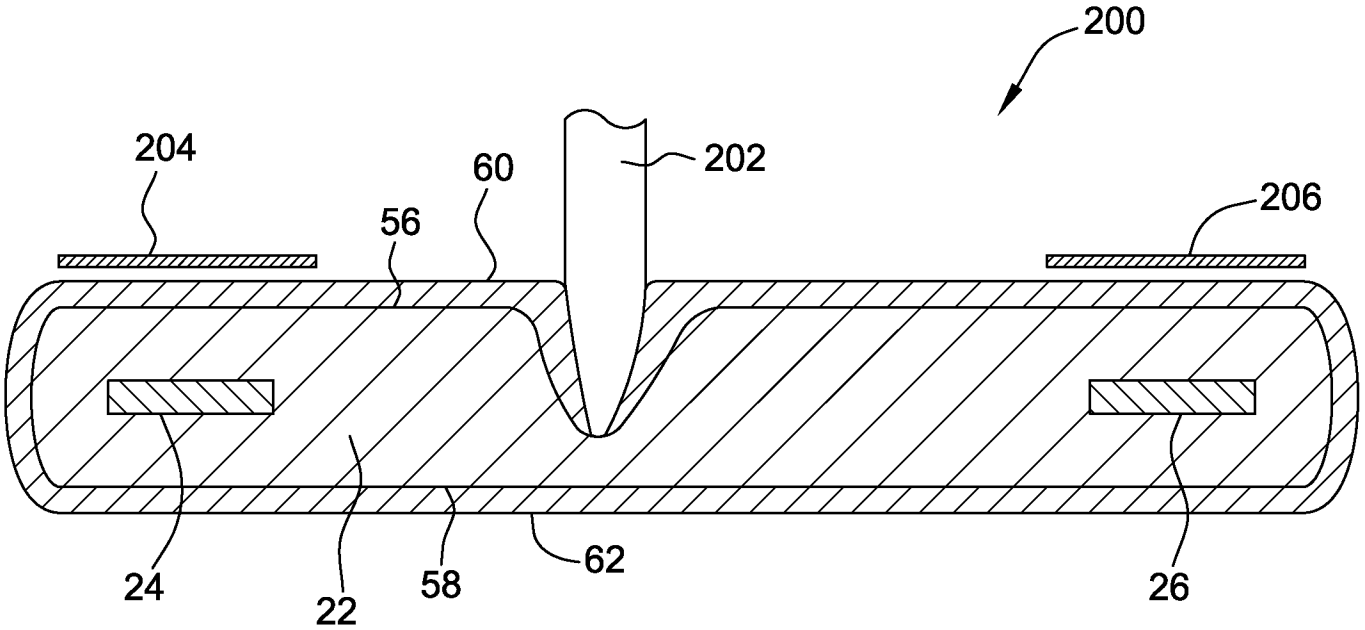
FIG. 5 is a schematic cross-sectional view of an example flexible homogeneous carbon polymeric heating element.

The heating element described herein also protects users against electrical discharge if the heating element is pierced with a conductive object, such as a nail. FIG. 5 is a schematic cross-sectional view of an example heating element 200. Unless otherwise noted, heating element 200 is substantially similar to heating element 20 (shown in FIG. 1). As shown in FIG. 5, a penetrating object 202 has partially pierced heating element 200. More specifically, penetrating object 202 has pierced second insulating material first layer 60 (polypropylene in the example embodiment).

First insulating material first layer 56 (polyethylene in the example embodiment) is relatively elastic. Accordingly, as shown in FIG. 5, penetrating object 202 has not pierced first insulating material first layer 56. The elasticity is due at least in part to a moderately weak adherence between first insulating material first layer 56 and second insulating material first layer 60. Because of the limited adherence, when penetrating object 202 applies pressures to first insulating material first layer 56, first insulating material first layer 56 loosens from second insulating material first layer 60 and stretches with penetrating object 202.

In the event that penetrating object 202 pierces first insulating material first layer 56, a minimal amount of current flows from elongate web 22 into penetrating object 202. This occurs partly because the stretching of first insulating material first layer 56 ensures that relatively little of penetrating object 202 actually contacts elongate web 22. Further, the total current flowing between first and second bus conductors 24 and 26 is widely distributed over the relatively large volume of elongate web 22. Accordingly, the current flowing through the portion of elongate web 22 in contact with penetrating object 202 is relatively low.

At least some known heating elements include shielding material covering an entire top surface of the heating elements. In contrast, as shown in FIG. 5, heating element 200 includes relatively little shielding material. In the example embodiment, heating element 200 includes a first strip 204 of shielding material and a second strip 206 of shielding material. First and second strips 204 and 206 facilitate discharging current from first and second bus conductors 24 and 26 in the event that penetrating object 202 contacts first bus conductor 24 or second bus conductor 26, as described herein.

First and second strips 204 and 206 are positioned atop second insulating material first layer 60. Further, first and second strips 204 and 206 extend along a length of heating element 200 such that first strip 204 is substantially aligned with first bus conductor 24 and second strip 206 is substantially aligned with second bus conductor 26. In the example embodiment, first and second strips 204 and 206 are metallic (e.g., aluminum, copper, etc.) tape. Alternatively, first and second strips 204 and 206 may be any material that enables heating element 200 to function as described herein.

Figure 6:
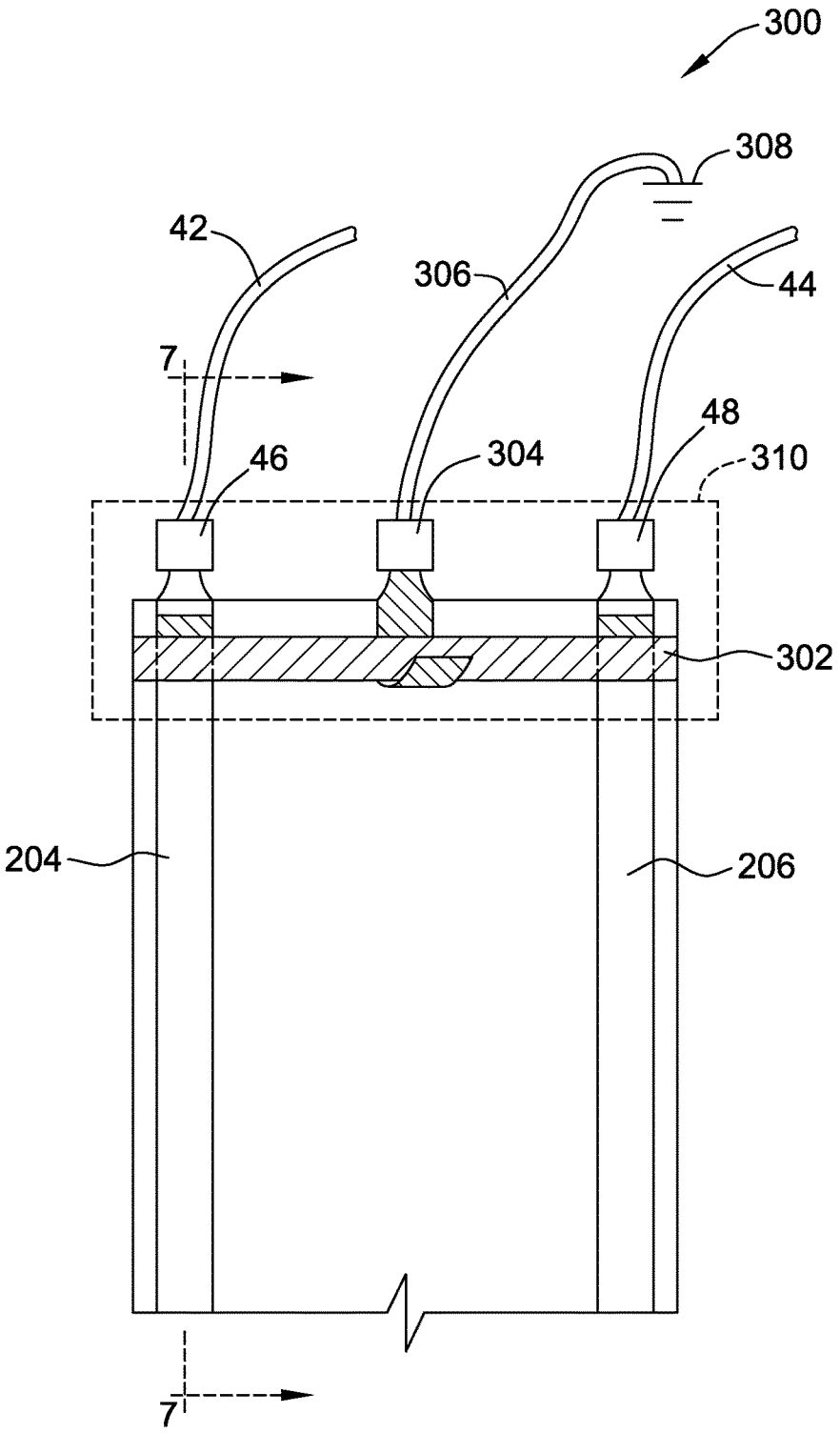
FIG. 6 is a top plan view of an example flexible homogeneous carbon polymeric heating element.
Figure 7:
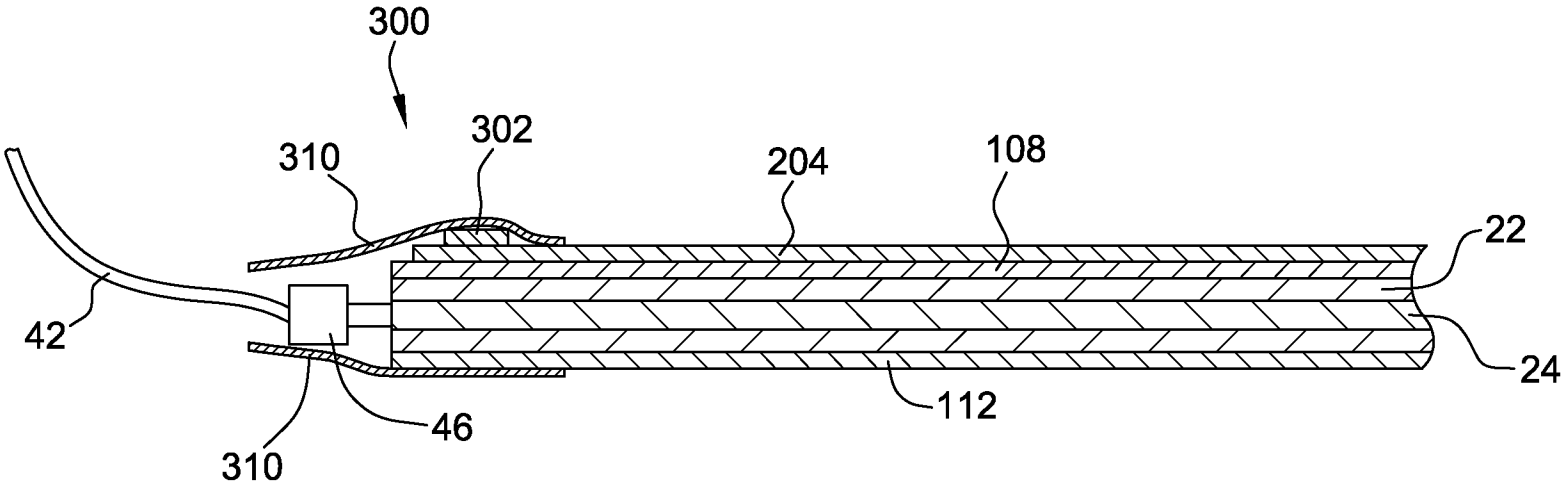
FIG. 7 is a longitudinal cross-sectional view of the flexible homogeneous carbon polymeric heating element taken along line 7-7 in FIG. 6.

FIG. 6 is a top plan view of an example flexible homogeneous carbon polymeric heating element 300. FIG. 7 is a longitudinal cross-sectional view of heating element 300 taken along line 7-7 in FIG. 6. Unless otherwise noted, heating element 300 is substantially similar to heating element 200 (shown in FIG. 5). First and second strips 204 and 206 extend along a length of heating element 300. In the example embodiment, a third strip 302 of shielding material extends between and substantially orthogonal to first and second strips 204 and 206. In the example embodiment, third strip 302 is metallic (e.g., aluminum, copper, etc.) tape. Alternatively, third strip 302 may be any material that enables heating element 300 to function as described herein. For example, third strip 302 may be a metallic busbar.

Third strip 302 is electrically coupled to first and second strips 204 and 206. A crimped connector 304 electrically couples third strip 302 to a lead wire 306, which is in turn electrically coupled to a ground 308. A sealant, or vulcanizing, tape 310 encapsulates third strip 302, the ends of first and second strips 204 and 206 in contact with third strip 302, and crimp connectors 46, 48, and 304. As shown in FIG. 7, tape 310 is applied to both a top and bottom of heating element 300 in the example embodiment.

In the event that a conductive object, such as penetrating object 202 (shown in FIG. 5) pierces heating element 300 and contacts first bus conductor 24 or second bus conductor 26, first, second, and third strips 204, 206, and 302 facilitate discharging current from first and second bus conductors 24 and 26. Specifically, if a conductive object contacts first bus conductor 24, the conductive object will also have pierced first strip 204. Accordingly, current will flow from first bus conductor 24 into first strip 204, from first strip into third strip 302, and from third strip 302 to ground 308 via lead wire 306. As such, current flows from first bus conductor 24 to ground, and does not flow into a user touching the conductive object. Thus, the configuration of heating element 300 protects a user against electrical discharge if the user inadvertently pierces heating element 300 and contacts first bus conductor 24 or second bus conductor 26 with a conductive object.

Example embodiments of a flexible homogeneous carbon polymeric heating element and methods for producing a flexible homogeneous carbon polymeric heating element are described above in detail. The systems and methods are not limited to the specific embodiments described herein, but rather, components of the systems and methods may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for producing a flexible homogeneous carbon polymeric heating element, said method comprising:

extruding an elongate web and a plurality of bus conductors through a die such that the plurality of bus conductors are embedded within the elongate web; and thermally bonding a first liner and a second liner to the elongate web including the embedded bus conductors, wherein the first liner and the second liner each include a water-resistant polyethylene inner layer that contacts the elongate web and a separate chemical-resistant polypropylene outer layer.

2. A method according to claim 1, wherein thermally bonding a first liner and a second liner to the elongate web comprises thermally bonding the first liner and the second liner to the elongate web simultaneously.

3. A method according to claim 1, wherein the polypropylene outer layer has a thickness between 0.02 and 0.04 millimeters, and wherein the polyethylene inner layer has a thickness between 0.01 and 0.03 millimeters.

4. A method according to claim 1, wherein extruding an elongate web comprises extruding an elongate web of a semi-conductive polymer including polyethylene mixed with carbon black.

5. A method according to claim 1, wherein thermally bonding a first liner and a second liner to the elongate web comprises thermally bonding the first liner and the second liner to the elongate web using a pair of temperature controlled rollers.

6. A method according to claim 1, further comprising cutting a plurality of slots through the thermally bound first liner, second liner, and elongate web using at least one cutting roller.

7. A method according to claim 6, further comprising applying heat and pressure to the first and second liners during the cutting such that the first and second liners insulate exposed edges of the elongate web at each of the plurality of slots.

8. A method according to claim 1, further comprising:

applying a first strip of shielding material to the first liner, the first strip of shielding material aligned with a first bus conductor of the plurality of bus conductors;

applying a second strip of shielding material to the first liner, the second strip of shielding material aligned with a second bus conductor of the plurality of bus conductors; and electrically coupling the first and second strips of shielding material using a third strip of shielding material.

9. A method according to claim 1, further comprising:

supplying the first liner from a first reel; and supplying the second liner from a second reel.

* * * * *